US011270557B2

(12) United States Patent
Heathcote et al.

(10) Patent No.: US 11,270,557 B2
(45) **Date of Patent: *Mar. 8, 2022**

(54) LOTTERY GAMING SYSTEM AND METHOD

(71) Applicant: IGT GLOBAL SOLUTIONS CORPORATION, Providence, RI (US)

(72) Inventors: Bradford Heathcote, Chepachet, RI (US); Aaron Michael Koll, Lincoln, CA (US); Sarah Simpkins, Warwick, RI (US)

(73) Assignee: IGT GLOBAL SOLUTIONS CORPORATION, Providence, RI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/926,862

(22) Filed: Jul. 13, 2020

(65) Prior Publication Data

US 2020/0410808 A1 Dec. 31, 2020

Related U.S. Application Data

(63) Continuation of application No. 16/194,967, filed on Nov. 19, 2018, now Pat. No. 10,713,900.

(51) Int. Cl.

| | |
|---|---|
| ***G07F 17/32*** | (2006.01) |
| ***G07F 17/42*** | (2006.01) |
| ***A63F 3/06*** | (2006.01) |
| ***G07C 15/00*** | (2006.01) |

(52) U.S. Cl.

CPC ..... *G07F 17/329* (2013.01); *A63F 3/06* (2013.01); *A63F 3/0605* (2013.01); *G07C 15/00* (2013.01); *G07F 17/326* (2013.01); *G07F 17/3209* (2013.01); *G07F 17/3244* (2013.01); *G07F 17/3262* (2013.01); *G07F 17/42* (2013.01); *G07F 17/3211* (2013.01)

(58) Field of Classification Search

None

See application file for complete search history.

(56) References Cited

U.S. PATENT DOCUMENTS

| | | | | |
|---|---|---|---|---|
| 5,393,057 | A | 2/1995 | Marnell, II | |
| 6,287,202 | B1 | 9/2001 | Pascal et al. | |
| 6,589,115 | B2 | 7/2003 | Walker et al. | |
| 6,857,958 | B2 | 2/2005 | Osawa | |
| 7,029,395 | B1 | 4/2006 | Baerlocher | |
| 8,202,152 | B2 | 6/2012 | Walker et al. | |
| 8,360,859 | B2 | 1/2013 | Walker et al. | |
| 8,651,935 | B2 | 2/2014 | Caro et al. | |
| 2005/0096130 | A1* | 5/2005 | Mullins | G07F 17/3244 463/27 |
| 2008/0015007 | A1 | 1/2008 | O'Brien | |
| 2009/0098923 | A1* | 4/2009 | Randhawa | G07F 17/329 463/17 |
| 2009/0117968 | A1 | 5/2009 | Krietemeyer et al. | |
| 2009/0264176 | A1* | 10/2009 | Walker | G07F 17/329 463/17 |
| 2015/0235506 | A1* | 8/2015 | Smith | G07F 17/326 463/19 |
| 2016/0086444 | A1 | 3/2016 | Filipour et al. | |

* cited by examiner

*Primary Examiner* — Jason T Yen

(74) *Attorney, Agent, or Firm* — Neal, Gerber & Eisenberg LLP

(57) ABSTRACT

A lottery gaming system and method providing players with various different lottery ticket purchase options, wherein higher wager levels have higher average expected payouts.

19 Claims, 13 Drawing Sheets

LOTTERY GAMING SYSTEM AND METHOD

PRIORITY CLAIM

This patent application is a continuation of, claims priority to and the benefit of U.S. patent application No. 16/194,967, filed on Nov. 19, 2018, now U.S. Patent No. 10,713,900, the entire contents of which is incorporated by reference herein.

BACKGROUND

The present disclosure relates to lottery gaming systems and methods, and more particularly to lottery gaming systems and methods that enable the play of lottery games. Certain lottery gaming systems may enable a player to select a number for a lottery ticket, randomly select an award to associate with that player-selected number, randomly select a winning draw number, and if the winning draw number matches the player-selected number, provide the player the award associated with the player-selected number.

BRIEF SUMMARY

In various embodiments, the present disclosure relates to a lottery gaming system including a processor and a memory device which stores a plurality of instructions, which when executed by the processor, cause the processor to: receive, via an input device, a player selection of one or more of a plurality of different symbols for a lottery ticket to be purchased by the player; receive, via the input device, for each player-selected symbol for the lottery ticket, a player selection of one of a plurality of different wager levels for that selected symbol for the lottery ticket; receive a payment for the lottery ticket from the player based on a quantity of the player-selected symbols and on the player-selected wager level; for each player-selected symbol for the lottery ticket, randomly select an award from a plurality of different awards to associate with that player-selected symbol, said random selection being in accordance with predetermined odds of randomly selecting each of the plurality of different awards associated with the player-selected wager level, wherein the plurality of different wager levels have different predetermined odds; create the lottery ticket for the player based on each of the player-selected symbols, the player-selected wager level, and the randomly selected award associated with each of the player-selected symbols; store data associated with the lottery ticket; cause the lottery ticket to be provided to the player; at a designated draw time for the lottery ticket, randomly select a winning draw symbol for the lottery ticket; and determine whether any of the player-selected symbols of the lottery ticket matches the winning draw symbol for the lottery ticket, and if so, determine the award associated with matched player-selected symbol to enable a payout of such determined award to the player for the lottery ticket.

In various embodiments, the present disclosure relates to a lottery gaming system including a processor and a memory device which stores a plurality of instructions, which when executed by the processor, cause the processor to: receive, via a playslip, a player selection of each of one or more of a plurality of different numbers for a lottery ticket; receive, via the playslip, a player selection of one of a plurality of different wager levels for the lottery ticket; for each player-selected number for the lottery ticket, randomly select an award from a plurality of different awards to associate with said player-selected number, each said random selection being in accordance with one of a plurality of different predetermined paytables that corresponds to the player-selected wager lever, wherein each predetermined paytable corresponds to a different one of the different wager levels, wherein each predetermined paytable includes a predetermined range of different awards, predetermined odds associated with each award of the range, and a predetermined expected payout associated with each award of the range, and wherein the different predetermined paytables have different predetermined expected payouts; responsive to receiving a payment for the lottery ticket, create the lottery ticket for the player based on each of the player-selected numbers, the player-selected wager level, and the randomly selected award associated with each of the player-selected numbers; store data associated with the lottery ticket; cause the lottery ticket to be provided to the player; and at a designated draw time for the lottery ticket, randomly select a winning draw number for the lottery ticket.

In various embodiments, the present disclosure relates to a method of operating a lottery gaming system including receiving, via an input device, a player selection of one or more of a plurality of different symbols for a lottery ticket to be purchased by the player; receiving, via the input device, for each player-selected symbol for the lottery ticket, a player selection of one of a plurality of different wager levels for that selected symbol for the lottery ticket; for each player-selected symbol for the lottery ticket, randomly selecting, via a processor, an award from a plurality of different awards to associate with that player-selected symbol, said random selection being in accordance with predetermined odds of randomly selecting each of the plurality of different awards associated with the player-selected wager level, wherein the plurality of different wager levels have different predetermined odds; creating the lottery ticket for the player based on each of the player-selected symbol, the player-selected wager level, and the randomly selected award associated with each of the player-selected symbols; storing data associated with the lottery ticket; causing the lottery ticket to be provided to the player; at a designated draw time for the lottery ticket, randomly selecting, via the processor, a winning draw symbol for the lottery ticket; determining, via the processor, whether any of the player-selected symbols matches the winning draw symbol for the lottery ticket, and if so, determining, via the processor, the award associated with matched the player-selected symbol.

Additional features are described in, and will be apparent from, the following Detailed Description and the figures.

DETAILED DESCRIPTION

In various embodiments, the present disclosure relates generally to a lottery gaming system and a method of operating a lottery gaming system that provides multiple different player selectable wagering options for a lottery ticket and multiple different average expected payouts respectively associated with the multiple different wagering options. In various embodiments, the lottery gaming system and method of operating the lottery gaming system enable a player to select any one of the plurality of different player selectable wagering options for each lottery ticket that the player desires to purchase.

Figure 1:
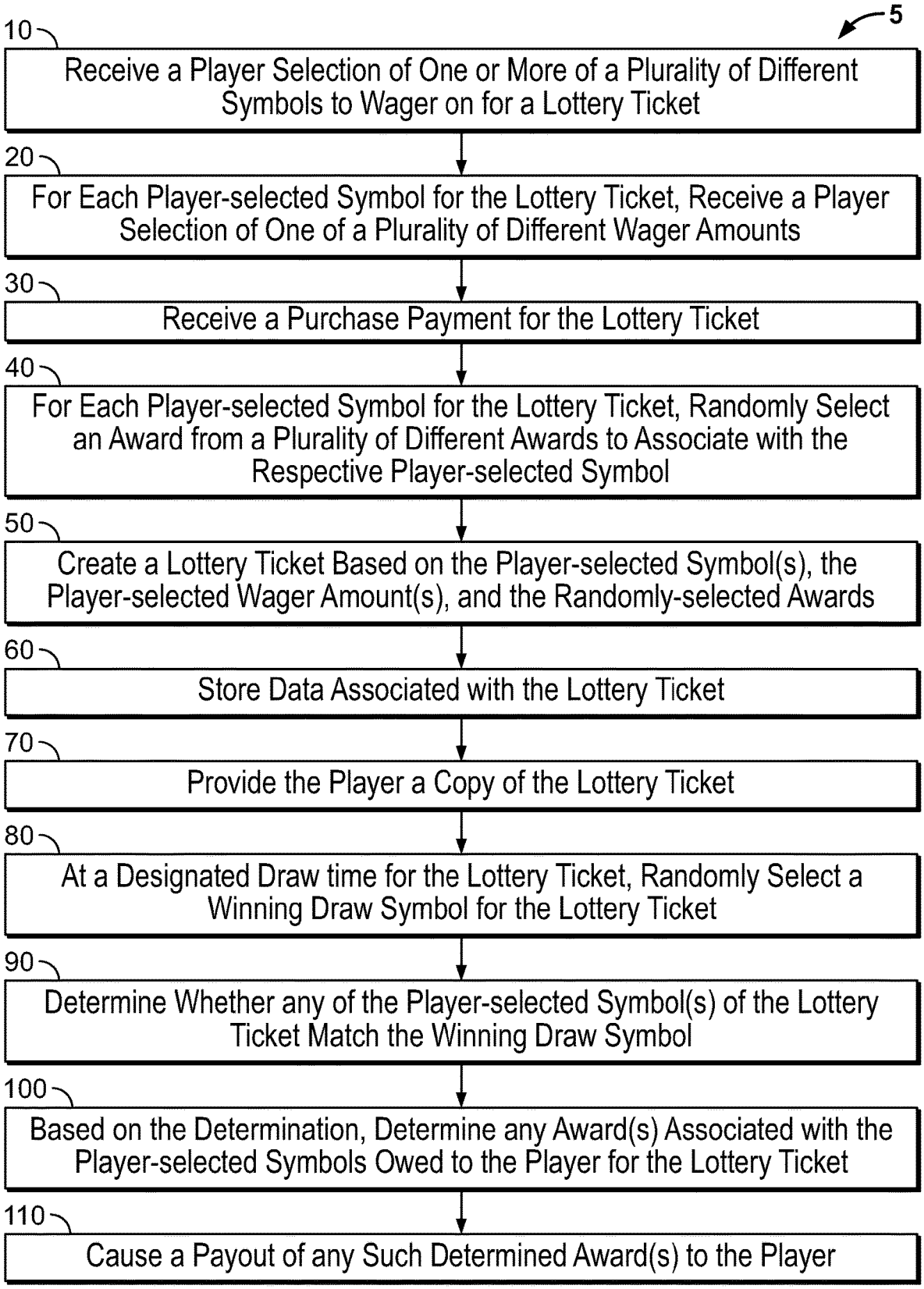
FIG. 1 is a flow chart of an example method for operating a lottery gaming system of one embodiment of the present disclosure.

FIG. 1 is a flowchart of an example method (indicated by numeral 5) of operating a lottery gaming system of the present disclosure. In various embodiments, the method is represented by a set of instructions stored in one or more memory devices and executed by one or more processors. Although the method is described with reference to the flowchart shown in FIG. 1, many other processes of performing the acts associated with this illustrated example method may be employed. For example, the order of certain of the illustrated blocks may be changed, certain of the illustrated blocks may be optional, or certain of the illustrated blocks may not be employed.

In the example embodiment illustrated in FIG. 1, the lottery gaming system is configured to: (1) receive from the player a selection of one or more of a plurality of different symbols to wager on for a lottery ticket to be purchased by the player, as indicated by block 10; (2) for each player-selected symbol for the lottery ticket, receive from the player a selection of one of a plurality of different wager amounts for the player-selected symbol(s) for the lottery ticket, as indicated by block 20; (3) receive a purchase payment (that functions as the wager) for the lottery ticket from the player, as indicated by block 30; (4) for each player-selected symbol for the lottery ticket, randomly select an award from a plurality of different awards to associate with that player-selected symbol, as indicated by block 40; (5) create a lottery ticket for the player based on the player-selected symbol(s), the player-selected wager amount(s), and the randomly-selected award(s), as indicated by block 50; (6) store data associated with the lottery ticket, as indicated by block 60; (7) provide the player a paper copy and/or a virtual copy of the lottery ticket, as indicated by block 70; (8) at the designated draw time for the lottery ticket, randomly select a winning draw symbol for the lottery ticket, as indicated by block 80; (9) determine whether any of the player-selected symbol(s) of the lottery ticket match the winning draw symbol, as indicated by block 90; (10) based on this determination, determine any award(s) associated with the matched player-selected symbol(s) that is owed to the player for the lottery ticket, as indicated by block 100; and (11) cause a payout of any such determined award(s) to the player for the lottery ticket, as indicated by block 110.

In various embodiments, the lottery gaming system is configured to randomly select each award to associate with each respective player-selected symbol in accordance with the odds for each different wager level (as further described below). In various embodiments, as the player's wager level increases for the player-selected symbols (and, thus, the player's total wager amount increases), the average expected payout increases as further described below. In various embodiments, this average expected payout increase is achieved through an improvement of the predetermined odds for randomly selecting at least one of the awards that can be associated with each player-selected symbol. In various other embodiments, this average expected payout increase is achieved through an improvement of the predetermined odds for randomly selecting each of a plurality of the awards that can be associated with each player-selected symbol. In various other embodiments, this average expected payout increase is achieved through an improvement of the predetermined odds for randomly selecting each of the plurality of the awards that can be associated with each player-selected symbol. Thus, as further explained below, in various embodiments, higher value awards are more likely to be associated with each of the player-selected number(s) as the player's wager level increases from wager level to higher wager level.

In various example embodiments, the symbols are all different numbers and the lottery gaming system is configured to: (1) receive from the player a selection of one or more of a plurality of different numbers to wager on for a lottery ticket to be purchased by the player; (2) for each player-selected number for the lottery ticket, receive from the player a selection of one of a plurality of different wager amounts for the player-selected number(s) for the lottery ticket; (3) receive a purchase payment (that functions as the wager) for the lottery ticket from the player; (4) for each player-selected symbol (such as each player-selected number) for the lottery ticket, randomly select an award from a plurality of different awards to associate with that player-selected number; (5) create a lottery ticket for the player based on the player-selected number(s), the player-selected wager amount(s), and the randomly-selected awards; (6) store data associated with the lottery ticket; (7) provide the player a paper copy and/or a virtual copy of the lottery ticket; (8) at the designated draw time for the lottery ticket, randomly select a winning draw number for the lottery ticket; (9) determine whether any of the player-selected number(s) of the lottery ticket match the winning draw number; (10) based on this determination, determine any award(s) associated with the player-selected numbers for the lottery ticket; and (11) cause a payout of any such determined award(s) to the player for the lottery ticket. It should thus be appreciated that the symbols employed by the lottery gaming system and method of the present disclosure may be any suitable symbols.

In various embodiments, as further described below, the lottery gaming system and method are configured to be provided by a lottery agency (such as a state lottery agency). In various other embodiments, as further described below, the lottery gaming system and method are configured to be operated by a third party that runs the lottery for a lottery agency (such as a state lottery agency).

1st Example Embodiment

In a first example embodiment, the lottery gaming system is configured to: (1) enable the player to select and purchase any one or more of the numbers 1 through 15 (inclusive of 1 and 15) for a lottery ticket; (2) enable the player to wager $1, $2, $5, or $10 on each selected number for that lottery ticket; and (3) randomly select an award to be associated with each player selected number from a range of different awards associated with each wager level. In this first example embodiment, the lottery gaming system is configured such that the average expected payout increases for that lottery ticket from approximately 61% at the $1 purchase price point per number (i.e., the $1 wager level per player selected number) up to approximately 70% at the $10 purchase price point per number (i.e., the $10 wager level per player selected number). It should be appreciated that in other embodiments of the present disclosure, the quantity of numbers, the numbers themselves, the quantity of wager amounts, the wager amounts themselves, the quantity of awards, the awards themselves, and/or the average expected payout percentages and increases may vary in accordance with the present disclosure.

Figure 2:
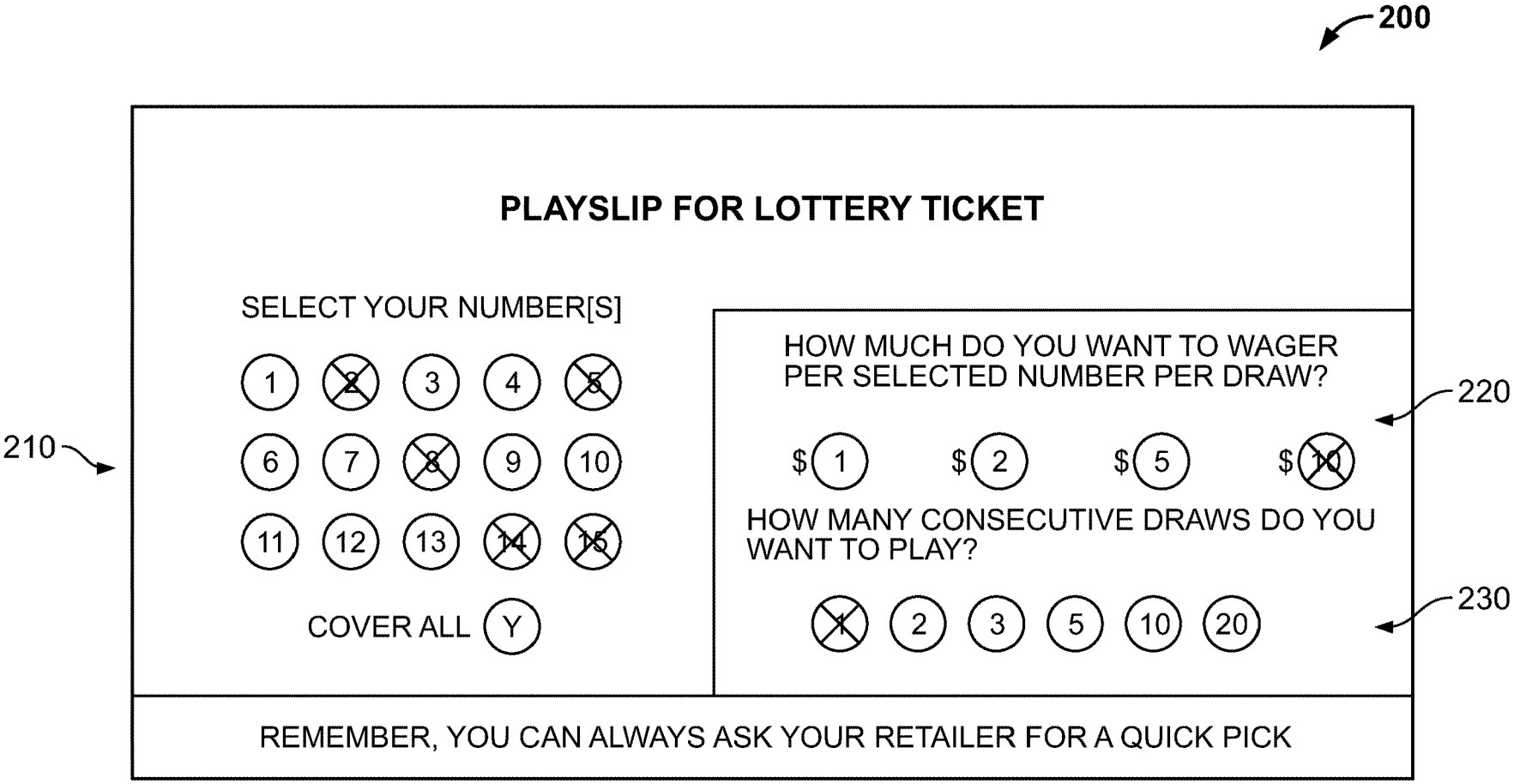
FIG. 2 is an example playslip for purchasing a lottery ticket through a lottery gaming system of one embodiment of the present disclosure.

In the first example embodiment, the lottery gaming system is configured to enable the player to use a single paper or virtual playslip to select the player selectable numbers, select the wager level (per player-selected number), and to purchase the lottery ticket. FIG. 2 illustrates an example playslip 200. This playslip 200 includes: (1) a symbol (or number) selection portion 210; (2) a wager selection portion 220; and (3) a draws selection portion 230. It should be appreciated that other embodiments of the playslip may include additional or alternative portions and player options and can be arranged in any suitable manner in accordance with the present disclosure.

In this example shown in FIG. 2, the number selection portion 210 of the playslip 200 includes fifteen different player-selectable numbers from which the player can select one or more numbers, and particularly a separate individual selectable area for each of the numbers 1 through 15 (inclusive of 1 and 15). In this example, each area includes a respective different number surrounded by a circle. The number selection portion 210 of this example embodiment also includes a cover all option that corresponds to the player selecting each of or all of the 15 numbers included in the number selection portion 210.

As shown in FIG. 2, in this example, the player has selected five numbers (and particularly, the numbers "2," "5," "8," "14," and "15") on this playslip 200 to purchase for their lottery ticket to be created. These player selections numbers are marked with Xs over the respective numbers in this example.

In this example embodiment of FIG. 2, the wager selection portion 220 of the playslip 200 includes four different player selectable wager levels that the player may select for the lottery ticket, and a particularly four separate individual selectable areas for each of the four different wager levels of $1, $2, $5, and $10. In this example embodiment, the player may select one of the different wager amounts of $1, $2, $5, or $10 per selected number per draw. In this example, each area includes a respective wager amount surrounded by a circle. In this example embodiment, the selected wager level is associated with each number selected by the player in the number selection portion 210. In this example embodiment, the single player selected wager amount is applied to each of the player-selected numbers (and the player cannot select different wager amounts on different player-selected numbers). This keeps the playslip, the lottery ticket, and the related math simple for the player to understand. In other example embodiments that are not shown, the lottery gaming system and method provides a playslip that enables the player to select different wager amounts on or for different player-selected numbers.

As shown in FIG. 2, in this example, the player has selected to wager $10 per selected number per draw. This player selected wager amount is marked with an X over the respective wager amount in this example.

In this example embodiment of FIG. 2, the draws selection portion 230 of the playslip 200 includes six different quantities of consecutive draws options that the player can select, and particularly six separate individual selectable areas for each of the six different quantity of consecutive draws 1, 2, 3, 5, 10, and 20. In this example embodiment, each area includes a respective quantity of draws surrounded by a circle. Each selected consecutive draws option corresponds to a different quantity of consecutive draws that the player-selected numbers are enrolled. For example, if the player selects the "3" consecutive draws option, then the player-selected numbers indicated in the number selection portion 210 are enrolled in the next three lottery number draws.

As shown in FIG. 2, in this example, the player has selected to enroll their player-selected numbers indicated in the number selection portion 210 for only "1" draw. This player selected quantity of draws is marked with an X over the respective quantity in this example. In this example, the player has selected five numbers, selected to wager $10 per player-selected number, and selected 1 draw; thus, the total player wager for the lottery ticket the player is purchasing is $50.

After making all of the needed player selections on the playslip 200, the lottery gaming system enables the player to purchase a lottery ticket through the lottery gaming system. In various embodiments of the lottery gaming system, the playslip is paper and the player may purchase the lottery ticket via the paper playslip. In various other embodiments of the lottery gaming system, the playslip is virtual and the player may purchase the lottery ticket via the virtual playslip. In various other embodiments, the lottery gaming system is configured to accommodate both paper and virtual playslips.

In various embodiments of the lottery gaming system, the player may purchase the lottery ticket via any suitable manner such as, but not limited to, one of the following: (1) a dedicated lottery kiosk (e.g., a lottery kiosk) configured to communicate over a data network (such as the Internet) to a lottery server (such as a lottery server 806 described below in connection with FIG. 8); (2) a retailer-operated lottery terminal configured to communicate over a data network (such as the Internet) to a lottery server (such as a lottery server 806 described below in connection with FIG. 8); (3) a personal computer configured to communicate over a data network (such as the Internet) to a lottery server (such as a lottery server 806 described below in connection with FIG. 8); and/or (4) a personal mobile device (such as a cellular telephone, tablet, or PDA) configured to communicate over a data network (such as a wireless or cellular data network) to a lottery server (such as a lottery server 806 described below in connection with FIG. 8).

In one such example, the lottery gaming system enables a player to use a paper playslip to purchase a lottery ticket at a retail location having a lottery terminal configured to receive the playslip and print the lottery ticket at the time of purchase in a conventional manner. In such lottery gaming systems, the retail operator typically receives the purchase price for the lottery ticket from the player in a conventional manner.

In another such example, the lottery gaming system enables a player to use a virtual playslip to purchase a lottery ticket through a retail lottery kiosk configured to display the playslip (as further described below), receive the player selections using the displayed playslip (as further described below), receive the wager from the player, and print the lottery ticket at the time of purchase. This example lottery kiosk may include an integral printer device and/or be in communication with a printer device for providing a printed lottery ticket to the player.

In another such example, the lottery gaming system enables a player to use a virtual playslip to purchase a lottery ticket electronically using a personal mobile device such as the player's mobile telephone. In one such embodiment, the lottery gaming system receives from this device the player selections and the wager from the player, and sends the player a virtual lottery ticket (which in certain instances can be printed by the player using a suitable personal printing device). Thus, it should be appreciated that in various example embodiments, the player may purchase a lottery ticket with a personal mobile device and, thus, may not be provided with a physical (i.e., paper) lottery ticket. Instead, an electronic (or virtual) version of the lottery ticket is provided to the player via, for example, an electronic mail to an email account associated with the player.

Figure 3:
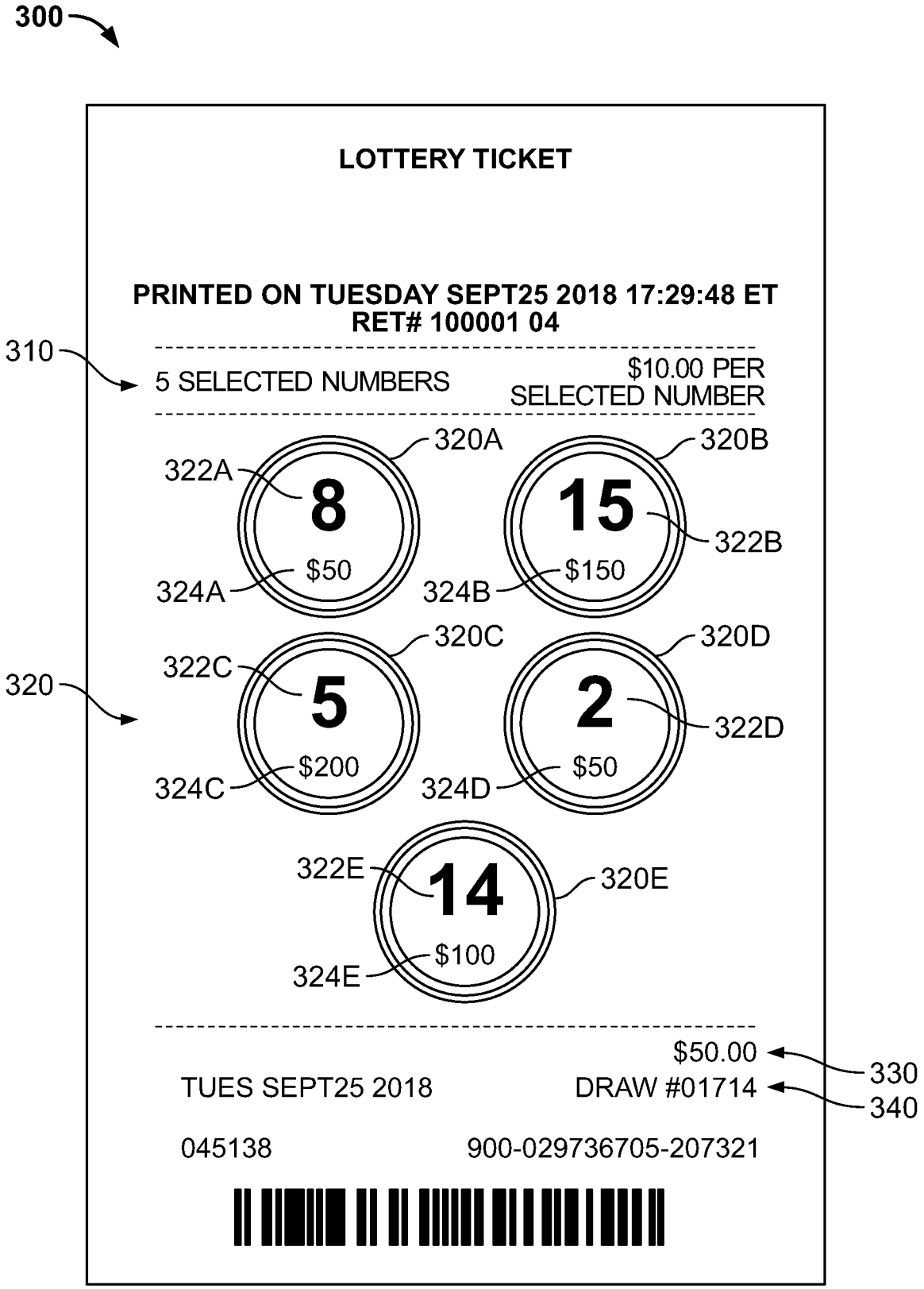
FIG. 3 is an example lottery ticket provided by one embodiment of the lottery gaming system of present disclosure based on the example playslip of FIG. 2.

FIG. 3 illustrates an example paper lottery ticket 300 that may be issued to a player based on the player-selected numbers, wager amounts, and draws that are indicated on their playslip (such as the example playslip 200 of FIG. 2). In this example embodiment, the lottery ticket 300 includes a wagering summary portion 310, a selected symbols (or numbers) portion 320, a total wager amount portion 330, and a draw symbols (or number(s)) identifier portion 340. It should be appreciated that in various embodiments, the lottery ticket may display or include additional or alternative information, such as a player identifier, a serial number, and/or any other relevant information. It should also be appreciated that the lottery ticket provided by the lottery gaming system of the present disclosure may be alternatively configured.

In this example embodiment, the wagering summary portion 310 of the lottery ticket 300 includes and indicates the total quantity of player-selected numbers (such as "5 selected numbers") and the player-selected wager level for the player-selected numbers (such as "$10.00 per selected number").

In this example embodiment, the selected numbers portion 320 of the lottery ticket 300 separately and individually includes and indicates each of the player-selected numbers (such as the respective player-selected numbers indicated in the number selection portion 210 of the playslip 200). In this example embodiment, each player-selected number includes a selected number identifier (such as number identifiers 322A, 322B, 322C, 322D, and 322E) and an associated award identifier (such as award identifiers 324A, 324B, 324C, 324D, and 324E). The respective selected number identifiers correspond to the respective player-selected numbers. The respective award identifiers correspond to the randomly-selected awards selected by the lottery gaming system. In this example embodiment, each randomly-selected award is associated with a respective selected number and each corresponds to the award provided to the player if the respective selected number is the winning draw number (as described below in connection with the example predetermined paytables 400 shown in FIGS. 4A and 4B).

In this example, (1) the player is provided a "$50" award if the number "8" 322A is selected as the winning draw number, (2) the player is provided a "$50" award if the number "2" 322D is selected as the winning draw number, (3) the player is provided a "$100" award 324E if the number "14" 322E is selected as the winning draw number, (4) the player is provided a "$150" award 324B if the number "15" 322B is selected as the winning draw number, and (5) the player is provided a "$200" award 324C if the number "5" 322C is selected as the winning draw number.

In this example embodiment, the total wager amount 330 of the lottery ticket 300 indicates the total wager amount associated with the lottery ticket. In this example, as mentioned above, the total wager amount ("$50.00") is based on the total quantity of player-selected numbers (e.g., 5 numbers), the player-selected wager level (e.g., $10.00 per selected number), and the quantity of consecutive draws (e.g., 1 draw).

In this example embodiment, the draw number(s) identifier portion 340 of the lottery ticket 300 indicates one or more draw number(s) that the player-selected numbers indicated in the selected numbers portion 320 are enrolled in (or are valid for). The draw number(s) may correspond to different draw entry numbers and/or draw entry times.

Figure 4A:
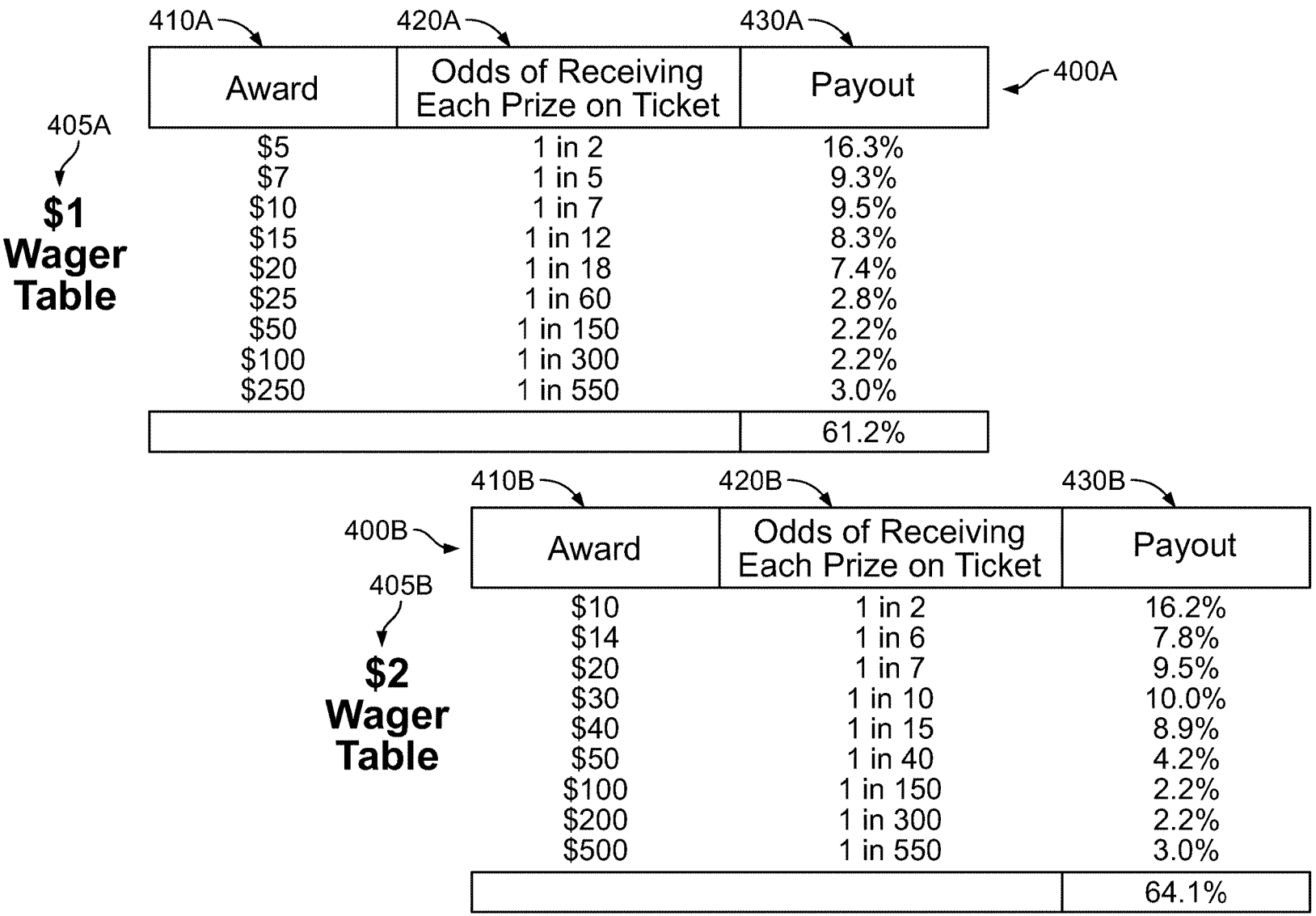
FIGS. 4A and 4B are example predetermined paytables associated with respective different wager levels of one embodiment of the lottery gaming system of present disclosure.
Figure 4B:
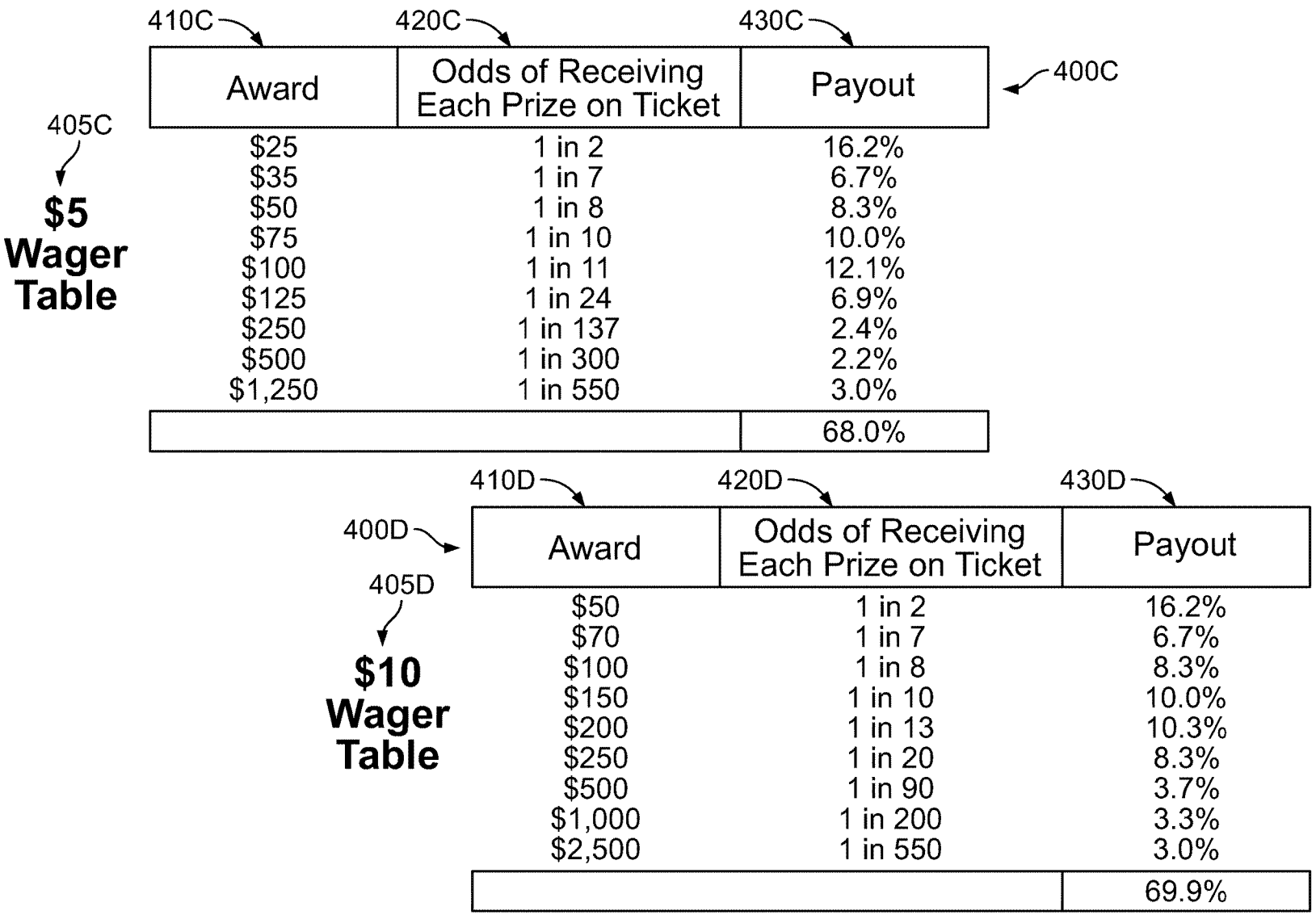
Figure 5A:
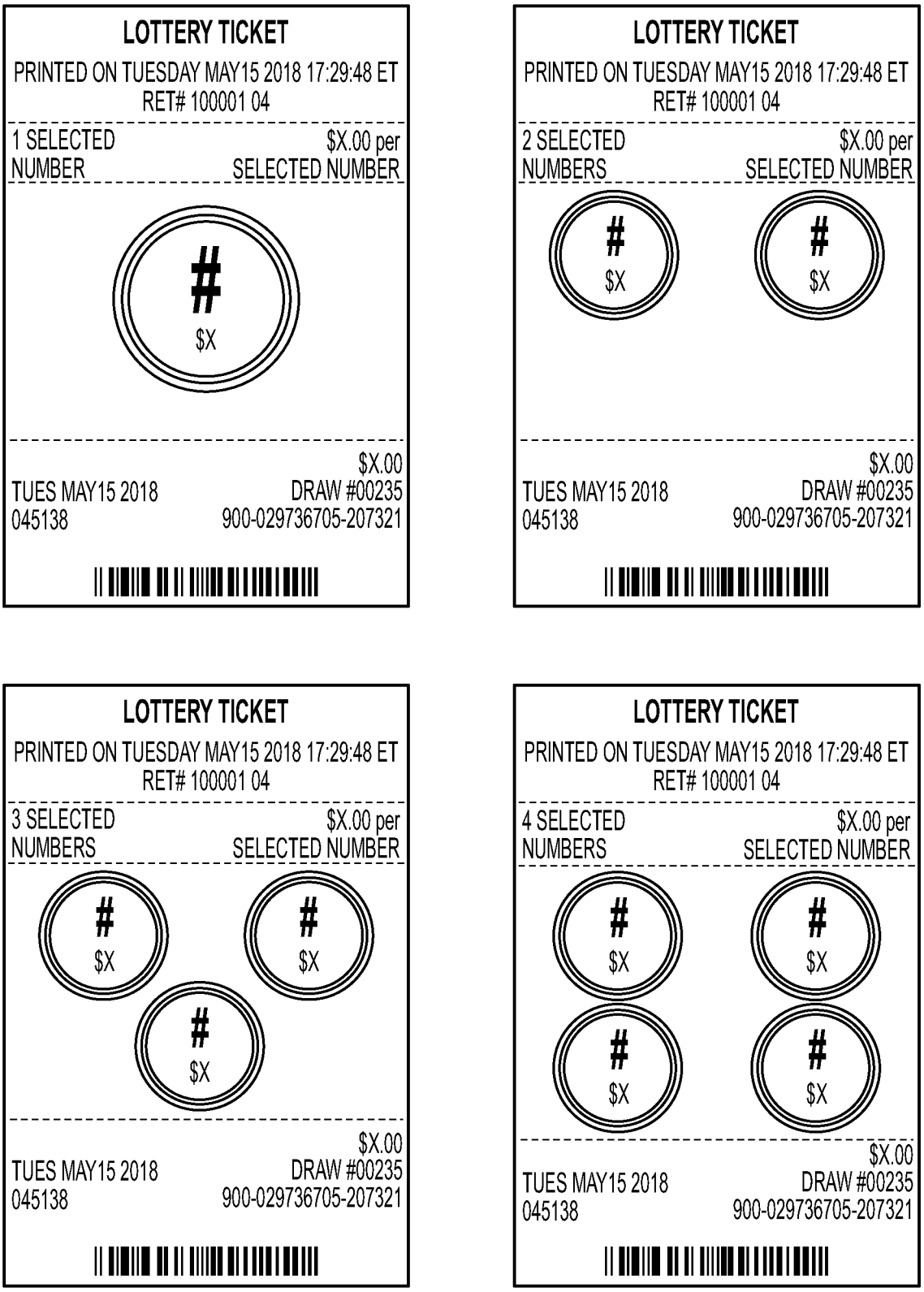
FIGS. 5A, 5B, 5C, 5D, and 5E are different example lottery tickets that can be provided by one embodiment of the lottery gaming system of the present disclosure.
Figure 5B:
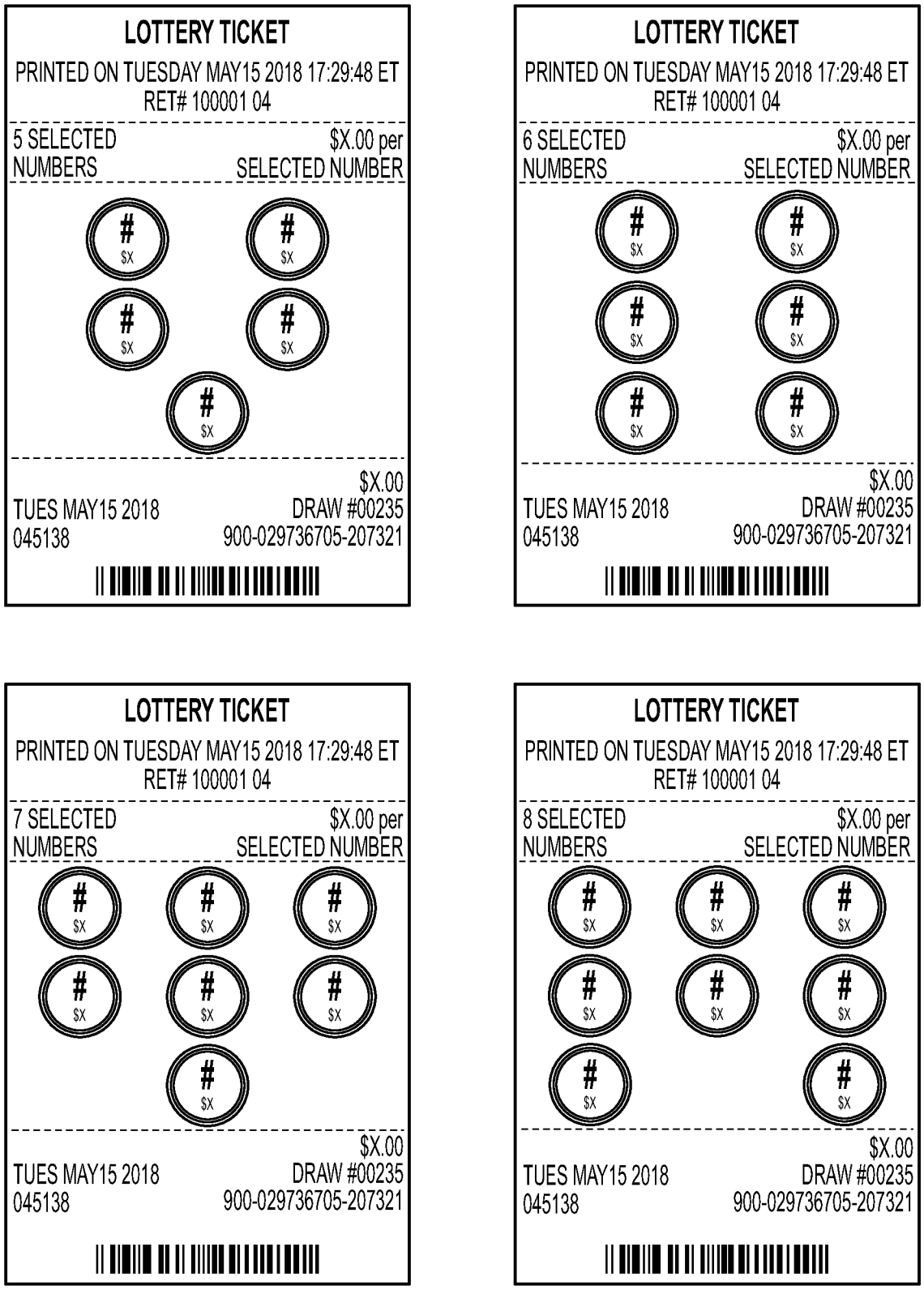
Figure 5C:
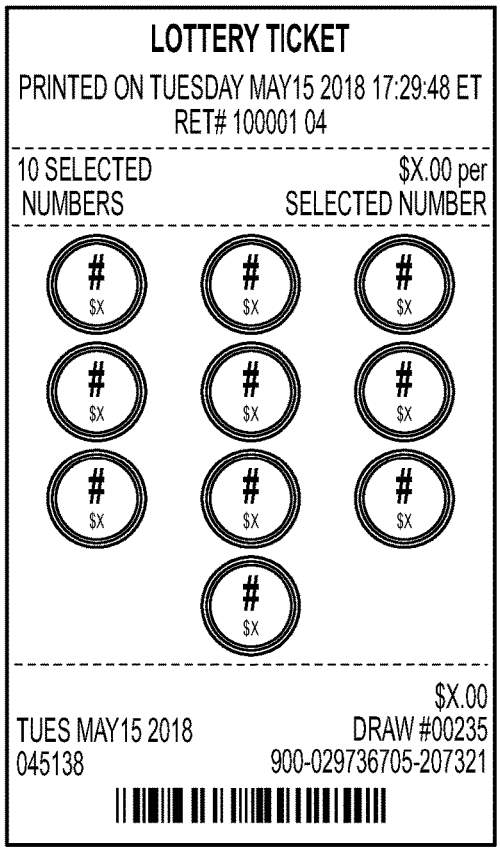
Figure 5C:
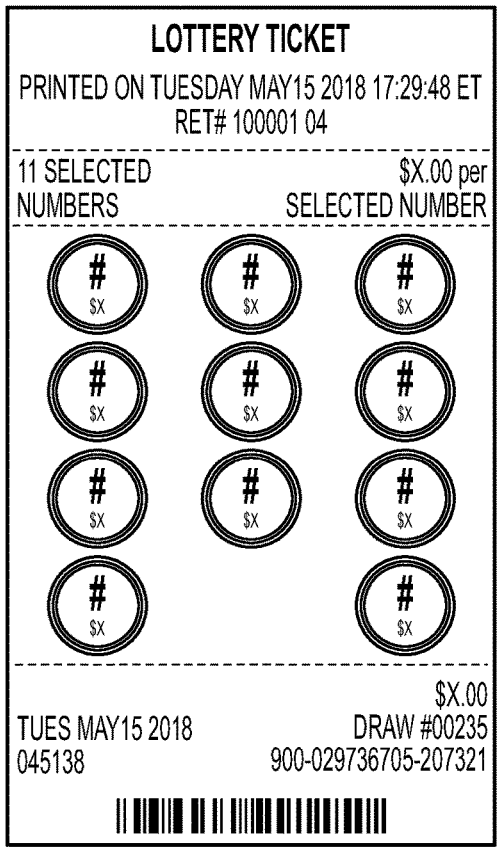
Figure 5C:
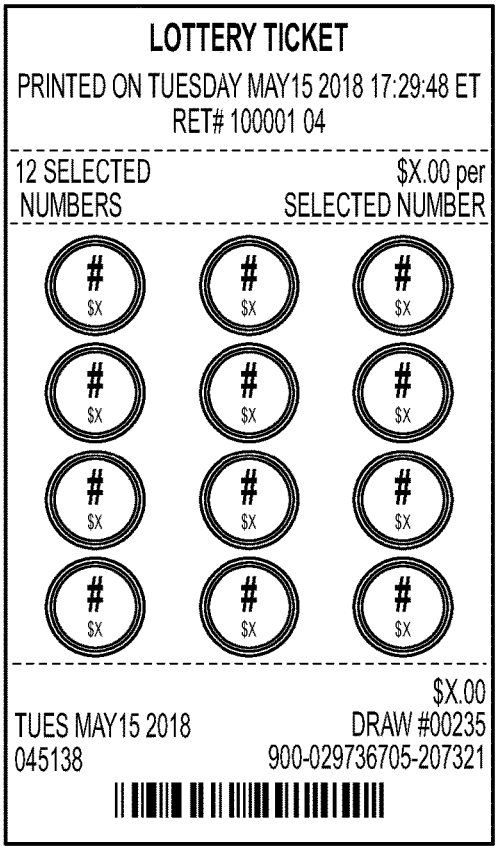
Figure 5D:
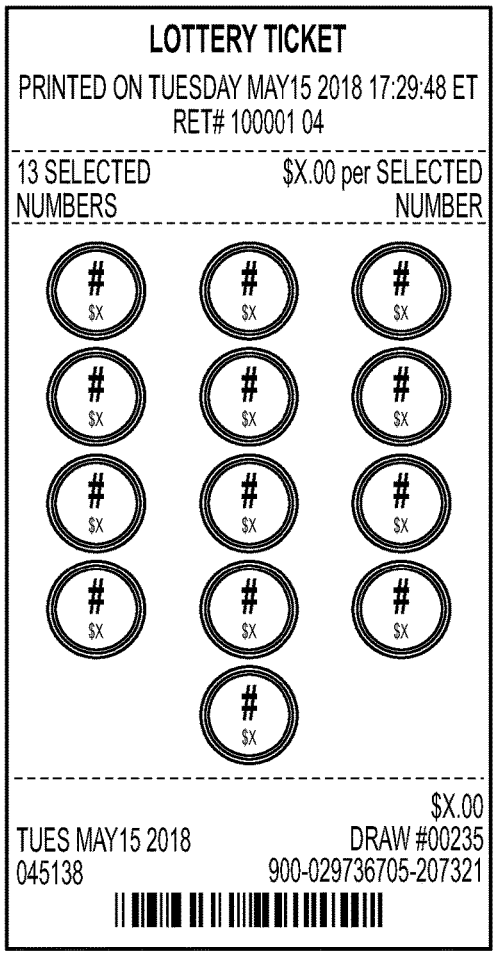
Figure 5D:
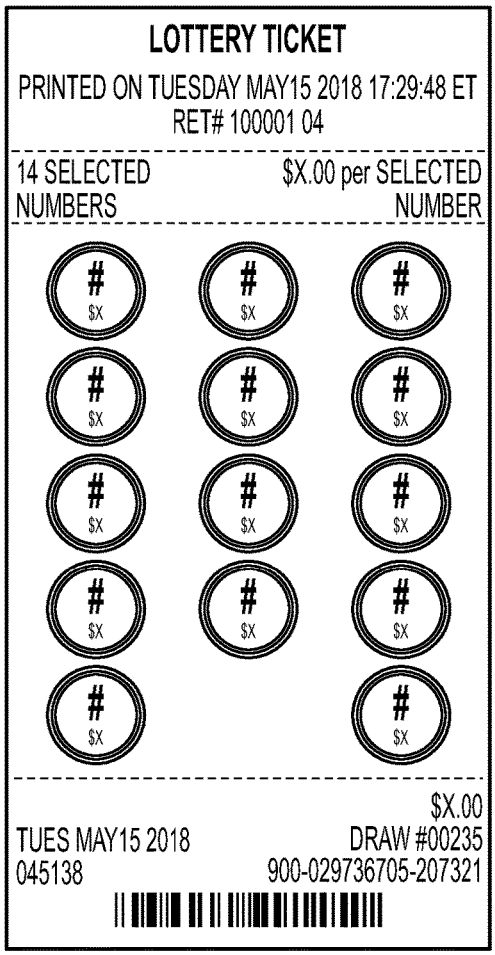
Figure 5E:
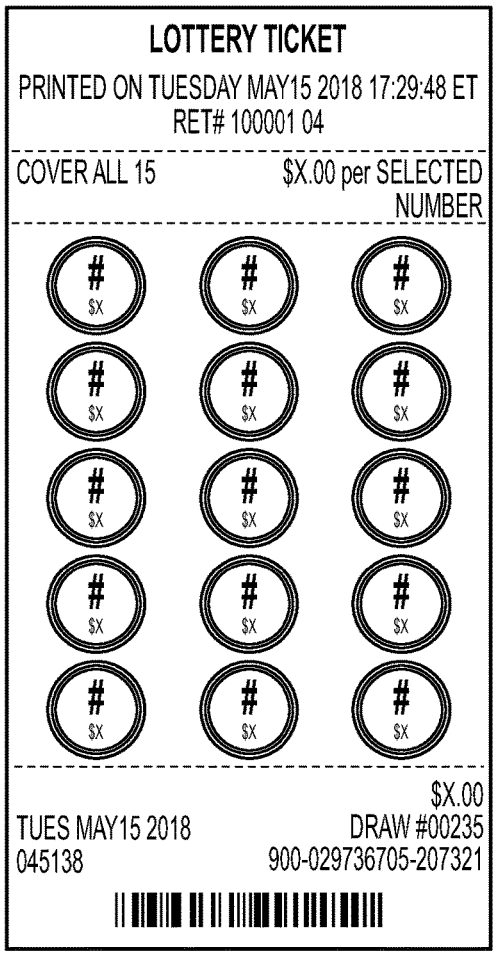
Figure 5E:
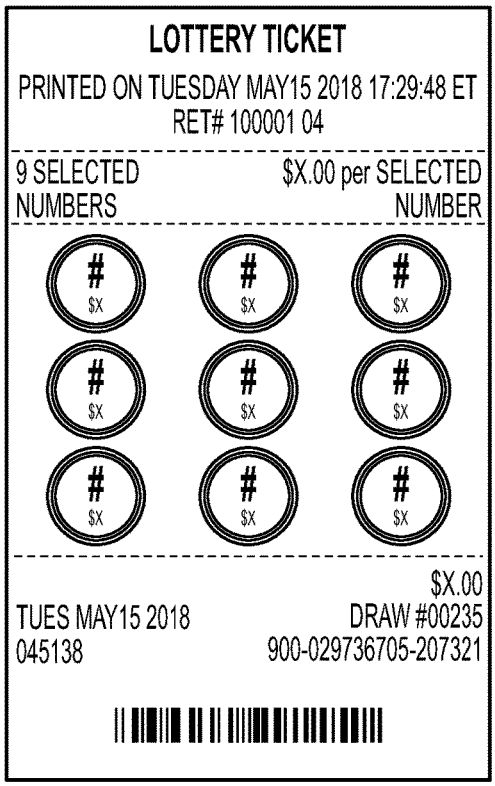

FIGS. 4A and 4B illustrate four different example predetermined paytables 400 associated with and respectively corresponding to the four different predetermined wager levels 405 in this example embodiment. In this example embodiment, each predetermined paytable 400 includes: (1) a predetermined wager level; (2) a predetermined award identifier column (such as columns 410A, 410B, 410C, and 410D); (3) a predetermined odds identifier column (such as column 420A, 420B, 420C, and 420D); and (4) a predetermined expected payout identifier column (such as column 430A, 430B, 430C, and 430D).

In this example embodiment, each award identifier column includes a plurality of different predetermined awards (identified by the award identifiers such as the dollar amounts) that may each be associated with any respective player-selected number for that respective player-selected wager level. In this example embodiment, each wager level is associated with nine different predetermined possible awards (which may sometimes be referred to as "award tiers" or "award levels"). Thus, in this example embodiment, for each respective player-selected number and a player-selected wager level, the lottery gaming system randomly selects one of the different predetermined possible awards from the respective award level and associates that randomly-selected possible award with the respective player-selected number.

Thus, in this example embodiment, each of the award columns 410A, 410B, 410C, and 410D includes a plurality of different predetermined awards. In this example embodiment, each of the award columns 420A, 420B, 420C, and 420D are different.

In this example embodiment, each of the odds identifier columns 420A, 420B, 420C, and 420D includes a plurality of different predetermined odds of the respective award being randomly selected. In this example embodiment, each of the odds identifier columns 420A, 420B, 420C, and 420D are different. As an example, as indicated on paytable 400A associated with the $1 wager level 405A, the lottery gaming system is configured to, on average, to randomly select the "$10" award to associate with a player-selected number in approximately one out of every seven random determinations.

In this example embodiment, each of the average expect payout columns 430A, 430B, 430C, and 430D includes a plurality of different predetermined average expected payouts. In this example embodiment, each expected payout is based on the award amount and the respective odds of selecting that award amount. In this example embodiment, each of the payout columns 430A, 430B, 430C, and 430D are different. In this example embodiment, the expected payout identifier column 430 includes a plurality of different expected payout identifiers that are associated with respective award tiers. For example, referring to the above example where the lottery gaming system randomly selected the "$10" award to associate with a player-selected number, the expected payout associated with the "$10" award is "9.5%."

It should be appreciated, as shown in FIGS. 4A and 4B, that the four different predetermined paytables have four different predetermined ranges of awards—wherein the higher wager levels have higher award ranges.

It should also be appreciated, as shown in FIGS. 4A and 4B, that the four different predetermined paytables have four different predetermined odds of selecting the same award. For example, the $1 wager level has 1/150 odds of randomly selecting the $50 award, the $2 wager level has 1/40 odds of randomly selecting the $50 award, the $5 wager level has 1/8 odds of randomly selecting the $50 award, and the $10 wager level has 1/2 odds of randomly selecting the $50 award.

As shown in FIGS. 4A and 4B, in this example lottery gaming system, the predetermined paytables 400 are configured such that the average expected payout increases for a lottery ticket from approximately 61% at the $1 wager level up to approximately 70% at the $10 wager level.

As shown in FIGS. 4A and 4B, in this example lottery gaming system, the predetermined paytables 400 are configured such that the odds of receiving an award of at least twenty five times the wager amount is as follows: (1) $1: 1 in 35; (2) $2: 1 in 27; (3) $5: 1 in 18; and (4) $10: 1 in 15. Thus, this configuration enables a higher scale of awards and higher chances of winning those awards.

It should be appreciated that the quantity of different wager levels or wager tiers may vary in accordance with the present disclosure.

In this example embodiment, the lottery gaming system makes a separate random determination of each of the awards associated with the player selected numbers shown on the example lottery ticket 300 of FIG. 3 in accordance with the odds of selecting such awards as set forth in the $10 paytable in FIG. 4B. In other words, for each player-selected symbol for the lottery ticket, the lottery gaming system randomly selects an award from a plurality of different awards of the designated award level to associate with that player-selected symbol, wherein the random selection is in accordance with predetermined odds of randomly selecting each of that plurality of different awards associated with the player-selected wager level, and wherein the plurality of different wager levels have different predetermined odds.

In this example embodiment, for each lottery ticket purchased, the lottery gaming system creates a data record corresponding to that lottery ticket. For example, when a lottery terminal is used to purchase a lottery ticket, the lottery gaming system creates a data record including suitable information such as but not limited to: (1) a timestamp (date and/or time) associated with when the lottery ticket was purchased; (2) the player-selected numbers; (3) the player-selected wager level; (3) the randomly-selected awards associated with each of the player-selected numbers; (4) the quantity of consecutive draws for which the player-selected numbers are enrolled; (5) the lottery ticket identification number; and (6) any other suitable information.

In various example embodiments, this data record is created by the lottery terminal and sent by the lottery terminal to the lottery server (such as described below in connection with the lottery server 806 of FIG. 8). It should be appreciated that the lottery ticket data record can be otherwise suitably created in accordance with the present disclosure.

In this example embodiment, at the designated times for each lottery game or draw, the lottery gaming system randomly selects a winning draw number based on equal odds for selecting each number. In this example, each of the 15 numbers has a 1/15 chance of being selected. In this example embodiment, the lottery gaming system randomly selects one of the possible player-selectable numbers (such as one of the numbers 1 through 15 (inclusive of 1 and 15). The selected winning draw number is applied for any purchased lottery ticket for that specific draw. In other words, this winning draw number can be used for zero, one, or a plurality of different lottery tickets purchased by zero, one, or a plurality of players.

In this example embodiment, after the lottery gaming system randomly selects the winning draw number, the lottery gaming system determines any award won by and to be subsequently provided to the player. More specifically, the lottery gaming system compares the winning draw number to each player-selected number included on a lottery ticket and determines whether any match is found. In response to determining that the winning draw number matches a player-selected number on that lottery ticket, the lottery gaming system is configured provide the player the randomly-selected award associated with that respective player-selected number (such as upon redemption of the lottery ticket by the player).

In this example, the lottery gaming system: (1) randomly selects the number "5"; (2) determines that the player selected the number "5" and thus has matched the winning draw number for that lottery ticket; (3) determines the award of $200 that has been won by the player; and (4) causes the award of $200 to be provided to the player in a suitable manner (such as any suitable conventional manner). For example, the player make take the winning lottery ticket to a lottery retailer to determine whether any of their player-selected number(s) match the winning draw number and will get paid any awards won by the lottery retailer in a conventional manner.

FIGS. 5A, 5B, 5C, 5D, and 5E illustrate 15 different example ticket configurations associated with fifteen different quantities of player-selected numbers. In this example embodiment, each of the fifteen different example ticket configurations includes: (1) a wagering summary portion; (2) a selected numbers portion; and (3) a total wager amount and a draw number(s) identifier portion.

$2^{nd}$ Example Embodiment

In a second example embodiment, the lottery gaming system is configured to enable the player to select and purchase multiple lottery tickets at one time. More specifically, in this second example embodiment, the lottery gaming system is configured to enable the player to use a single lottery ticket paper or virtual playslip to purchase multiple lottery tickets.

Figure 6:
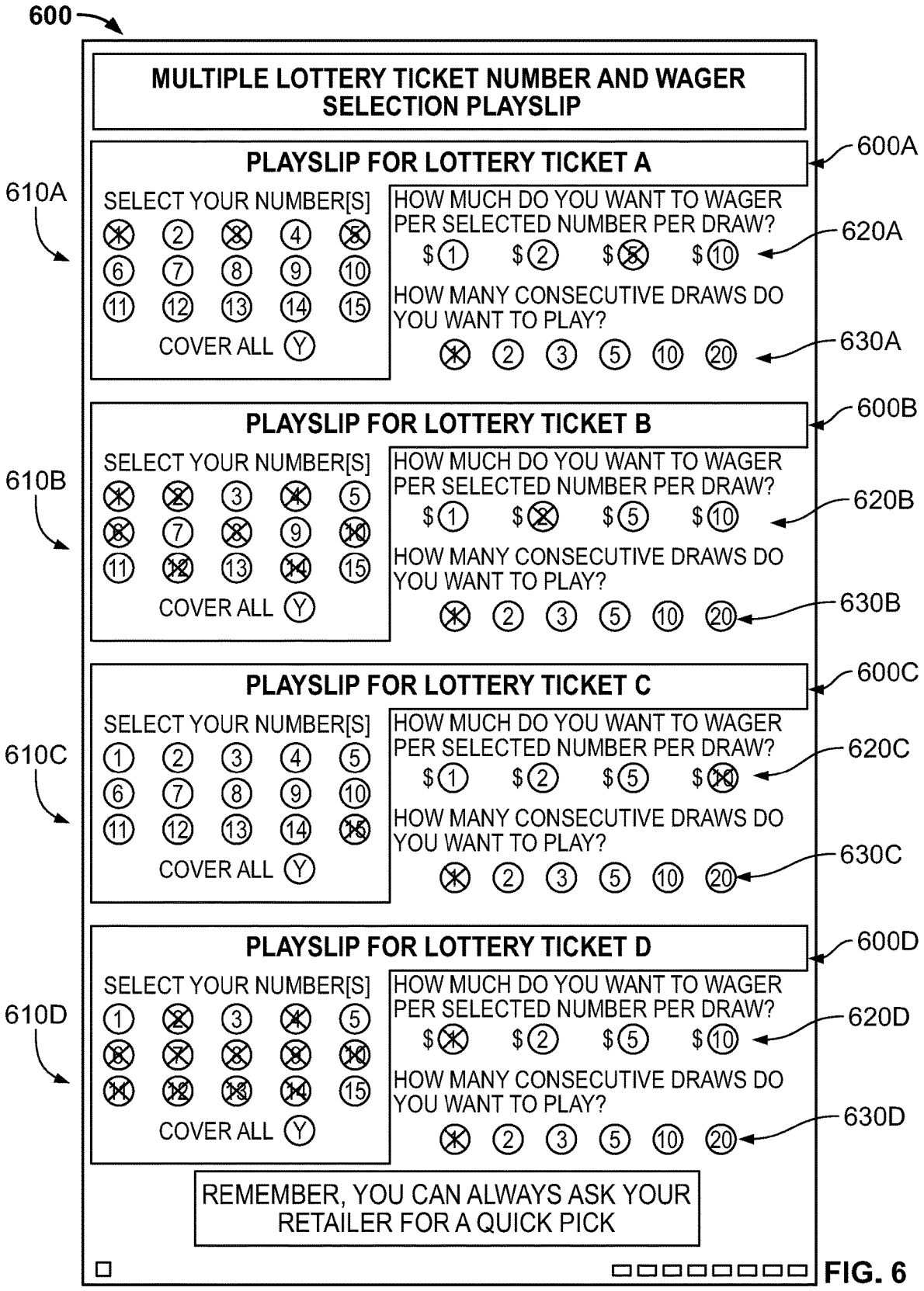
FIG. 6 is another example playslip for purchasing a plurality of lottery tickets through one embodiment of the lottery gaming system of the present disclosure.

FIG. 6 illustrates an example multiple lottery ticket number and wager selection playslip 600. This example playslip 600 includes: (1) a playslip for Ticket A portion 600A; (2) a playslip for Ticket B portion 600B, (3) a playslip for Ticket C portion 600C; and (4) a playslip for Ticket D portion 600D. Thus, in this example embodiment, the player may purchase four lottery tickets using the same single playslip 600. It should be appreciated that any suitable quantity of lottery tickets may thus be purchased via a single playslip in accordance with the present disclosure.

In this example embodiment, each of the playslip for ticket portions includes: (a) a number selection portion 610; (b) a wager selection portion 620; and (c) a draws selection portion 630. In this example embodiment, each of the number selection portions 610 correspond to the number selection portion 210 of FIG. 2, each of the wager selection portions 620 correspond to the wager selection portion 220 of FIG. 2, and each of the draws selection portions 630 correspond to the draws selection portion 230 of FIG. 2. These portions are for the same purposes and function in the same manner described above (and thus do not need to be described again).

As seen in FIG. 6, in this example for lottery ticket A 600A, the player selects three numbers (i.e., "1," "3," and "5"), selects to wager "$5.00 per selected number" of lottery ticket A, and selects to enroll the three player-selected numbers of lottery ticket A in one upcoming draw.

In this example for lottery ticket B 600B, the player selects eight numbers (i.e., "1," "2," "4," "6," "8," "10," "12,", and 14"), selects to wager "2.00 per selected number" of lottery ticket B, and selects to enroll the eight player-selected numbers of lottery ticket B in one upcoming draw.

In this example for lottery ticket C 600B, the player selects one number (i.e., "15"), selects to wager "$10.00 per selected number" of lottery ticket C, and selects to enroll the one player-selected number of lottery ticket C in one upcoming draw.

In this example for lottery ticket D 600D, the player selects eleven numbers (i.e., "2," "4," "6," "7," "8," "9," "10," "11," "12," 13," and "14), selects to wager "$1 per selected number" of lottery ticket D, and selects to enroll the eleven player-selected numbers of lottery ticket D in one upcoming draw.

As described above, after making the player number selections on the playslip 600 of FIG. 6, the lottery gaming system enables the player to purchase the lottery tickets.

Figure 7:
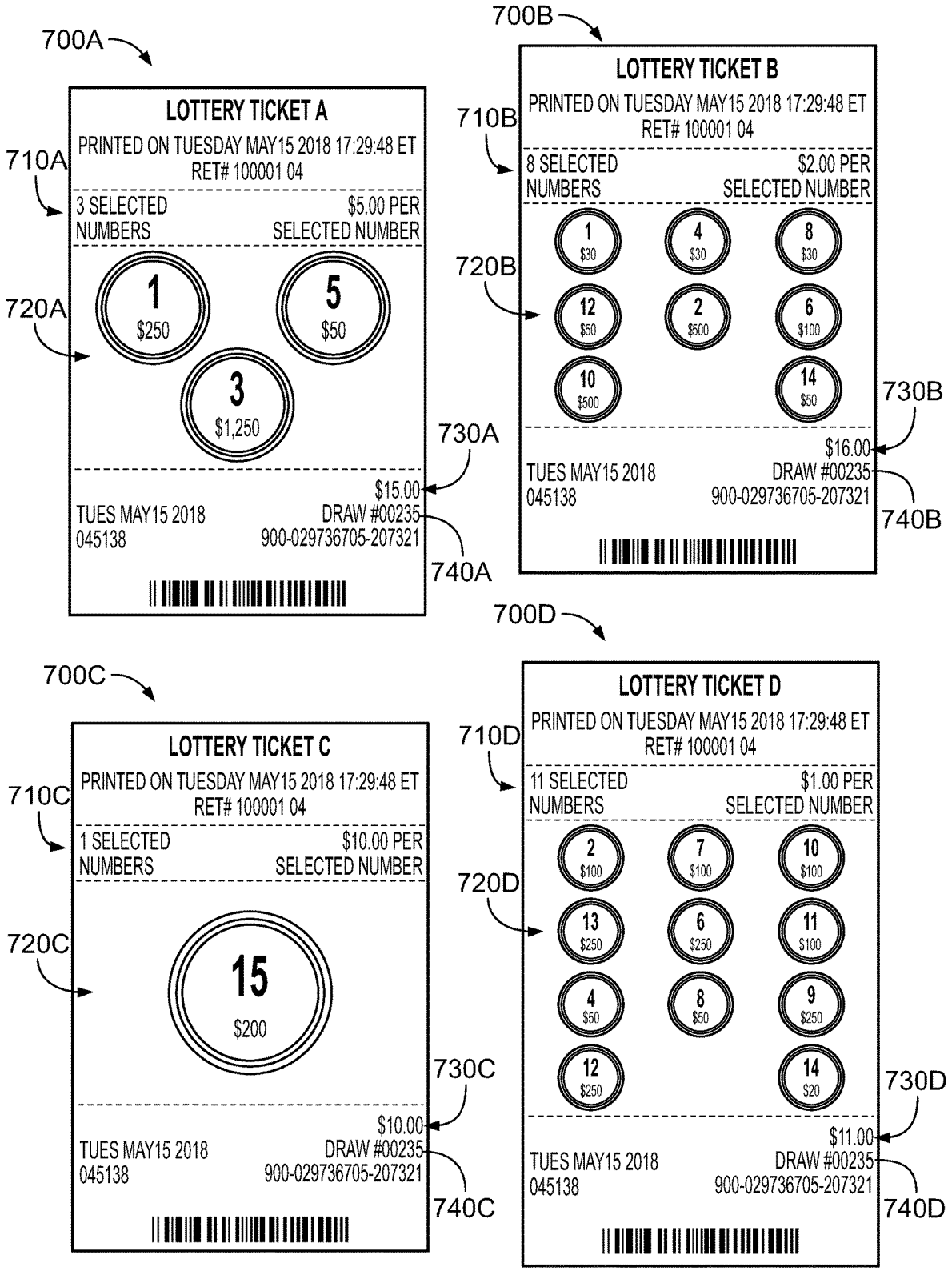
FIG. 7 illustrates a plurality of example lottery tickets provided by one embodiment of the lottery gaming system of the present disclosure based on the example playslip of FIG. 6.

FIG. 7 illustrates four example lottery tickets 700A, 700B, 700C, and 700D generated based on the player-selected numbers, the player-selected wager levels, and the randomly-selected awards associated with respective player-selected numbers. In this example embodiment, each of the lottery tickets 700A, 700B, 700C, and 700D corresponds to a different respective one of the playslip portions 600A, 600B, 600C, and 600D.

It should be appreciated that each of the lottery tickets has the same sections as the lottery ticket shown in FIG. 3 and described above. Accordingly, for brevity, these sections are not described in more detail here.

As described above, the lottery gaming system randomly selects an award to associate with each player-selected number included on each lottery ticket. For example, the lottery gaming system randomly selects each award to associate with each player-selected number in accordance with the example paytables 400 of FIGS. 4A and 4B as described above.

As described above, in this example embodiment, when a lottery ticket is purchased, the lottery gaming system creates a data record corresponding to the lottery ticket as described above.

As described above, in this example embodiment, at the designated draw or game times, the lottery gaming system selects a winning draw number for each of the lottery tickets.

As described above, in this example embodiment, after the lottery gaming system randomly selects the winning draw number for each lottery ticket, the lottery gaming system determines any awards to provide the player.

It should be appreciated that various ticket configurations associated with different quantifies of player-selected numbers are possible. For example and as described above, FIGS. 5A, 5B, 5C, 5D, and 5E illustrate various example ticket configurations associated with different quantities of player-selected numbers. In this example embodiment, each of the different example ticket configurations include a wagering summary portion, a selected numbers portion, a total wager amount and a draw number(s) identifier portion. It should be appreciated that other configurations may additionally or alternatively be employed.

In this example embodiment shown in FIG. 7, the different lottery tickets are displayed as four separate lottery tickets. It should be appreciated that in different embodiments, the multiple lottery tickets may be provided as a single combined lottery ticket.

Alternative Embodiments

In various example embodiments described above, the lottery gaming system enables the player to select a same wager level for each player-selected symbol indicated for the lottery ticket. In other example embodiments, the lottery gaming system enables the player to select respective wager levels for each respective player selected symbol. For example, the lottery gaming system may enable the player to select a first wager level (such as $1) for a first player-selected symbol and select a different second wager level (such as $5) for a second player-selected symbol on the same playslip for a lottery ticket. In certain such embodiments, the lottery gaming system randomly selects the respective award associated with the corresponding player-selected number based on the player-selected wager level.

In various example embodiments described above, the player selects a quantity of consecutive draws for which the player-selected symbols are enrolled. In various other example embodiments, the player selects a quantity of time-based draws for which the player-selected symbols are enrolled. For example, the player may select to play in morning draws, mid-day draws, evening draws, etc. In various example embodiments, the player may select a quantity of consecutive time-based draws for which the player-selected symbols are enrolled. For example, the player may select to enroll their symbols for ten consecutive morning draws (thus enrolling their symbols for consecutive draws over a ten day period). In various other embodiments, the player may select to enroll their symbols for ten consecutive draws including morning draws and evening draws (thus enrolling their symbols for consecutive draws over a five day period). However, it should be appreciated that other embodiments may employ additional or alternative techniques for indicating a quantity of draws for which their symbols are enrolled.

Example Lottery Gaming Systems—General

As mentioned above, in various embodiments, the lottery gaming system and method of the present disclosure are configured to be operated by a lottery agency (such as a state lottery agency).

As mentioned above, in various other embodiments, the lottery gaming system and method of the present disclosure are configured to be operated by a third party that runs the lottery for a lottery agency (such as a state lottery agency).

Figure 8:
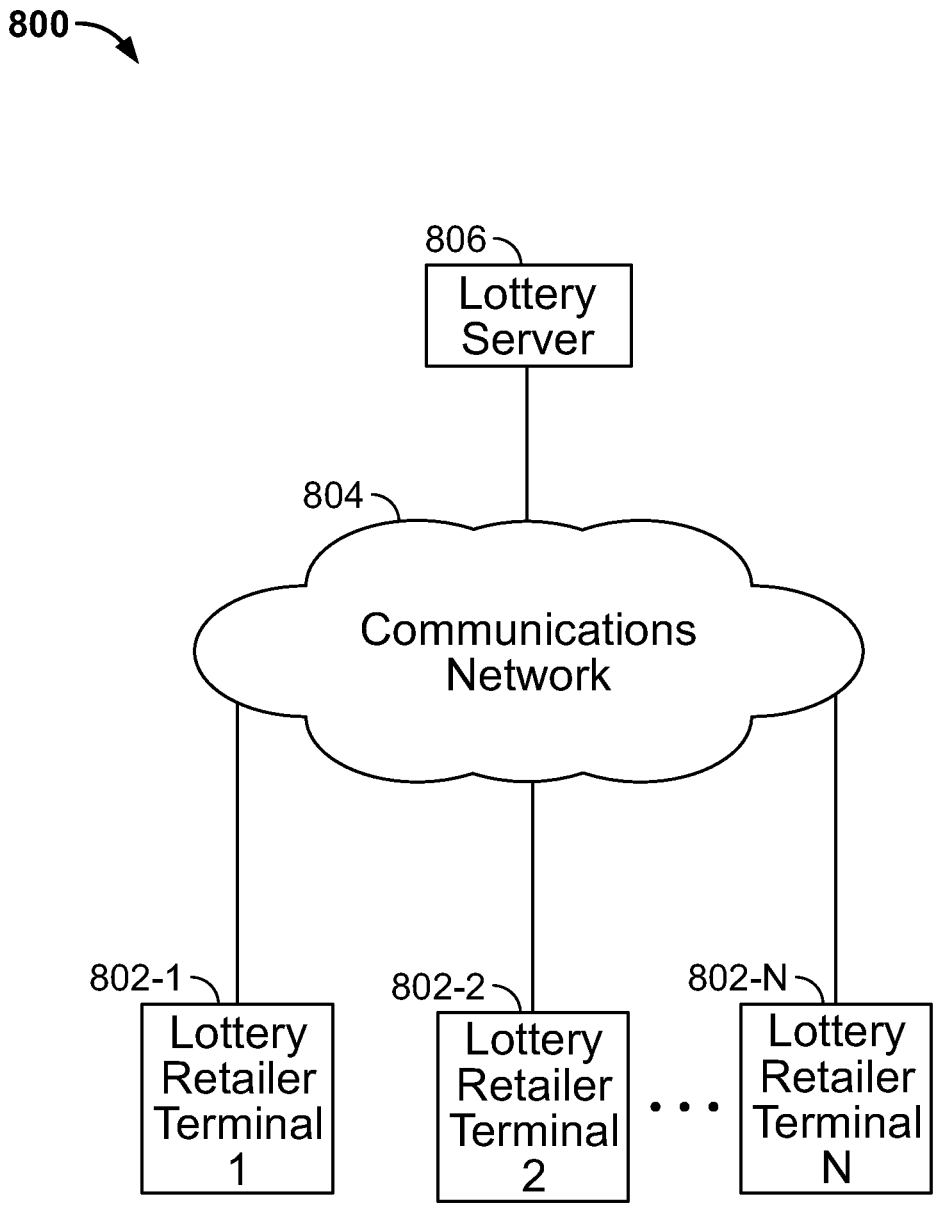
FIG. 8 depicts an example lottery gaming system of one embodiment of the present disclosure.

FIG. 8 illustrates an example networked lottery gaming system 800 for either such implementation. This example network lottery gaming system 800 generally includes: (1) a plurality of lottery retailer terminals 802-1 to 802-N; (2) a communications network 804; and (3) one or more lottery servers such as lottery server 806. Generally, the retailer terminals 802-1 to 802-N and the lottery server 806 are configured to perform the functions described above and further described below.

In this example embodiment, each retailer terminal 802 corresponds to (or is associated with) a particular lottery retailer. For example, the first retailer terminal 802-1 of FIG. 8 may be associated with a first lottery retailer, such as a convenience store, and the second retailer terminal 802-2 of FIG. 8 may be associated with a second lottery retailer, such as a supermarket. It should be understood that any suitable quantity of lottery retailer terminals may be employed in the lottery gaming system 800, along with any suitable quantity of corresponding lottery servers 806.

In various example embodiments, the lottery retailer terminal 802 includes one or more processor(s). Generally, the processor is operative to perform or process instructions, and in particular, to operate in accordance with the various methods described herein. For example, the processor of the lottery retailer terminal 802 may be operable to enable the lottery retailer terminal 802 to transmit data to (and receive data from) the lottery server 806. More specifically, the processor may enable the transmission of data representing each lottery ticket.

In various example embodiments, the lottery retailer terminal 802 includes one or more input device(s). The input devices of the lottery retailer terminal 802 may include components such as an optical scanner and/or a barcode scanner, for reading and/or for deriving information associated with a playslip and/or a lottery ticket. For example, a lottery ticket may include registration marks, authenticity data, various codes, micro-printed indicia, one or more sense marks, and/or other lottery indicia that must be read. Examples of additional input devices include, but are not limited to, a keypad, a mouse, an image capturing device (e.g., an optical character recognition (OCR) device), a biometric reader, a portable storage device (e.g., a memory stick), and the like.

In various example embodiments, the input device(s) of the lottery retailer terminal 802 may include a clock. The clock may be employed to detect, derive and/or append time and/or date information for use by the lottery server 806 to: (i) create a data record corresponding to lottery tickets purchased at the lottery retailer terminal 802, (ii) to determine redemption time, round and/or date information associated with lottery tickets, and/or (iii) determine whether a lottery player has redeemed their lottery ticket in a manner that qualifies the player to receive a particular redemption or settlement value (for example, if the player makes a lottery ticket redemption request prior to the revealing of a full lottery outcome).

In various example embodiments, the lottery retailer terminal 802 includes one or more output device(s). Such output device(s) may include such components as a display for outputting information to a lottery player or to a terminal operator (e.g., win/loss information and/or payout amounts), one or more benefit output devices (e.g., a cash drawer, a currency dispenser), a printer for producing a physical record (e.g., paper slip, receipt, ticket, voucher, coupon, etc.) that defines a lottery ticket, audio/video output device(s), and the like.

In various example embodiments, the lottery retailer terminal 802 also includes one or more communications port(s), such as a serial port, a modem or the like. Generally, the communications port of the lottery retailer terminal 802 may be operable to facilitate two-way data communications between (i) the lottery retailer terminal 802, and (ii) the lottery server 806. In accordance with some embodiments, the communications port of the lottery retailer terminal 802 may operate to facilitate the transmission of information between the lottery retailer terminal and a player device such as a personal digital assistant (PDA), cell phone and/or a dedicated (e.g., a proprietary) device.

In various example embodiments, the lottery retailer terminal 802 includes a data storage device such as a hard disk, optical or magnetic media, random access memory (RAM) and/or read-only memory (ROM), or the like memory device. Generally, the data storage device of the lottery retailer terminal 802 stores a software program, the software program enabling a processor of the retailer terminal 802 to perform various functions including some or all of the various steps described herein. For example, as noted above with respect to FIGS. 1 to 7, in accordance with certain embodiments, the lottery retailer terminal 802 may be configured to perform some or all of the functions of the lottery server 806 (and vice versa) such that the lottery server 806 and the lottery retailer terminal 802 may be considered as the same "device."

In various example embodiments, a lottery sales device may be utilized in place of a lottery retailer terminal 802. Such a lottery sales device may be implemented as a lottery server, a controller, a dedicated hardware circuit, an appropriately programmed general-purpose computer, or any other equivalent electronic, mechanical or electro-mechanical device. Thus, in various embodiments, a lottery sales device may include, for example, but is not limited to: (1) a video lottery terminal that may include a touch sensitive screen for use by a player; (2) a personal computer (e.g., which communicates with a remote lottery server); or (3) a personal mobile device such as a mobile telephone, a tablet, or a personal digital assistant. The lottery sales device may include any or all of the devices of the aforementioned systems.

In this example embodiment, the lottery server 806 operates to: (1) receive and/or store data associated with one or more lottery tickets including such data as: (a) ticket identifier(s), and (b) ticket indicia; (2) determine at least a first redemption value associated with a lottery ticket; (3) receive a redemption request associated with the lottery ticket; (4) determine a time or round of play associated with the redemption request; and (5) transmit an indication of the appropriate redemption value to a lottery retailer terminal (e.g., for output or display to a lottery player and/or lottery terminal operator).

In various example embodiments, the lottery server 806 includes one or more processor(s). Such a processor functions to process instructions, and in particular, to operate in accordance with various methods described herein. For example, the processor may operate to enable the lottery server 806 to transmit data to (and receive data from) the lottery retailer terminal 802. More specifically, the processor of the lottery server 806 may enable the transmission of data representing a lottery ticket, as well as information defining one or more payout(s) associated with that lottery ticket to or by a specific one of the lottery retailer terminals 802 shown in the lottery network 800 of FIG. 8. Thus, the lottery server 806 may be implemented as a system controller, a dedicated hardware circuit, an appropriately and particularly programmed general-purpose computer, or any other equivalent electronic, mechanical or electro-mechanical device capable of providing for one or more of the embodiments described herein.

In various example embodiments, the lottery server 806 includes one or more input device(s). Examples of such input devices include a keypad, a mouse, a touch-screen, a random number generator, a microphone, and other digital or analog input devices.

In various example embodiments, the lottery server 806 also includes one or more output device(s). Example of output device(s) of the lottery server 806 include a monitor or other display for outputting information to an operator of the lottery server 806 (e.g., for displaying information such as statistical or sales data, win and loss information and/or payout amounts), a printer for producing a physical record (e.g., a report) of such data, and the like. In addition, the lottery server 806 may include one or more communications ports, such as a serial port, modem or the like, operable to facilitate two-way data communications between (i) the lottery server 806 and (ii) one or more lottery retailer terminals 802.

In various example embodiments, the lottery server 806 includes a data storage device (e.g., a hard disk or hard drive, a media-based (removable) memory, or the like). In certain embodiments, the data storage device of the lottery server 806 stores at least one software program, which includes a program to enable the processor of the lottery server 806 to perform some or all of the various steps and functions of at least one implementation of the methods described in detail herein. In addition, the data storage device of the lottery server 806 may operate to store one or more databases including a lottery ticket database and a lottery ticket redemption status database.

In various example embodiments, the lottery server 806 includes a lottery ticket server device that is located at a lottery ticket printing facility, and may also function to manage the ticket printing process. The lottery server 806 may also function to develop a lottery game matrix (e.g., determining base payouts, win frequencies, and the like) and to match static lottery content with secure paytable (or payout distribution) data. In certain embodiments, a lottery ticket printer device for use in such lottery gaming systems may utilize the game matrix information from the lottery server and may apply it to the secure paytable data.

In certain example embodiments, a retailer terminal (such as the first retailer terminal 802-1) of FIG. 8 is configured to perform some or all of the functions of the lottery server 806. Thus, in certain example embodiments, the lottery server 806 and the retailer terminal (such as the first retailer terminal 802-1) (or another given retailer terminal and server pairing) may be considered as the same "device."

Generally, the communications network 804 of FIG. 8 includes one or more local and/or wide-area network(s) proprietary and/or public network(s) (e.g., the Internet) for facilitating two-way data communications between the retailer terminals 802 and the lottery server 806. The lottery server 806 may communicate with lottery retailer terminals 802 directly or indirectly, via a wired or wireless medium, such as via the Internet, via a local area network (LAN), via a wide area network (WAN), via an Ethernet, via a Token Ring, via a telephone line, via a cable line, via a radio channel, via an optical communications line, via a satellite communications link, or via any other appropriate communications system or combinations thereof. Any number and type of devices may be in communication with the lottery server 806, and communication between the lottery retailer terminals 802 and the lottery server 806 may be direct or indirect. A variety of communications protocols may be part of any such communications system, including, but not limited to: Ethernet (or IEEE 802.3), SAP, ATP, Bluetooth™, and TCP/IP.

It should be understood that devices in communication with each other need not be continually transmitting to each other. On the contrary, such devices need only transmit to each other as necessary, and may actually refrain from exchanging data most of the time. For example, a device in communication with another device via the Internet may not transmit data to the other device for days or weeks at a time. In some embodiments, a server may not be necessary and/or preferred. For example, in one or more embodiments, methods described herein may be practiced on a stand-alone gaming device and/or a gaming device in communication only with one or more other gaming devices. In such an embodiment, any functions described as performed by the computer may instead be performed by one or more gaming devices.

As used herein, a lottery retailer may include a merchant who sells lottery tickets at a particular location, authenticates winning lottery tickets, redeems authenticated winning lottery tickets, and/or provides awards to players for winning lottery tickets. Examples of various lottery retailers include, but are not limited to, convenience stores, gas stations, supermarkets, and gaming establishments.

Various changes and modifications to the present embodiments described herein will be apparent to those skilled in the art. Such changes and modifications can be made without departing from the spirit and scope of the present subject matter and without diminishing its intended technical scope. It is therefore intended that such changes and modifications be covered by the appended claims.

The claims are as follows:

1. A gaming system comprising:

a processor; and a memory device which stores a plurality of instructions, which when executed by the processor, cause the processor to:

receive data representing a player selection of one or more of a plurality of different symbols for a virtual lottery ticket to be purchased by the player and made by the player via an input device;

receive data representing for each player-selected symbol for the virtual lottery ticket, a player selection of one of a plurality of different wager levels for that selected symbol for the virtual lottery ticket and made by the player via the input device;

receive data representing a payment for the virtual lottery ticket from the player based on a quantity of the player-selected symbols and on the player-selected wager level;

for each player-selected symbol for the virtual lottery ticket, randomly select an award from a plurality of different awards to associate with that player-selected symbol, said random selection being in accordance with predetermined odds of randomly selecting each of the plurality of different awards associated with the player-selected wager level, wherein the plurality of different wager levels have different predetermined odds;

create the virtual lottery ticket for the player based on each of the player-selected symbols, the player-selected wager level, and the randomly selected award associated with each of the player-selected symbols;

store data associated with the created virtual lottery ticket;

cause the virtual lottery ticket to be provided to the player;

at a designated draw time for the virtual lottery ticket, randomly select a winning draw symbol for the virtual lottery ticket; and determine whether any of the player-selected symbols of the virtual lottery ticket matches the winning draw symbol for the virtual lottery ticket, and if so, determine the award associated with matched player-selected symbol to enable a payout of such determined award to the player for the virtual lottery ticket.

2. The gaming system of claim 1, wherein two of the different wager levels have two different associated ranges of awards, and wherein the higher wager level of the two different wager levels has a higher associated range of awards.

3. The gaming system of claim 1, wherein two of the different wager levels have different associated ranges of awards, and wherein two of the same awards associated with the two different wager levels have different predetermined odds of being randomly selected.

4. The gaming system of claim 1, wherein for each player-selected symbol for the virtual lottery ticket, the wager levels for said player-selected symbols must be the same.

5. The gaming system of claim 1, wherein each random selection of the award to associate with each player-selected symbol is separate each other random selection of each award to associate with each of the other player-selected symbols.

6. The gaming system of claim 1, wherein the data representing the player selection of one or more of the plurality of different symbols for the virtual lottery ticket is based on a virtual playslip.

7. A method of operating a gaming system, the method comprising:

receiving data representing a player selection of one or more of a plurality of different symbols for a virtual lottery ticket to be purchased by the player and made by the player via an input device;

receiving data representing for each player-selected symbol for the virtual lottery ticket, a player selection of one of a plurality of different wager levels for that selected symbol for the virtual lottery ticket and made by the player via the input device;

receiving data representing a payment for the virtual lottery ticket from the player based on a quantity of the player-selected symbols and on the player-selected wager level;

for each player-selected symbol for the virtual lottery ticket, randomly selecting an award from a plurality of different awards to associate with that player-selected symbol, said random selection being in accordance with predetermined odds of randomly selecting each of the plurality of different awards associated with the player-selected wager level, wherein the plurality of different wager levels have different predetermined odds;

creating the virtual lottery ticket for the player based on each of the player-selected symbols, the player-selected wager level, and the randomly selected award associated with each of the player-selected symbols;

storing data associated with the created virtual lottery ticket;

causing the virtual lottery ticket to be provided to the player;

at a designated draw time for the virtual lottery ticket, randomly selecting a winning draw symbol for the virtual lottery ticket; and determining whether any of the player-selected symbols of the virtual lottery ticket matches the winning draw symbol for the virtual lottery ticket, and if so, determine the award associated with matched player-selected symbol to enable a payout of such determined award to the player for the virtual lottery ticket.

8. The method of claim 7, further comprising, receiving data representing a payment for the virtual lottery ticket from the player based on a quantity of the player-selected symbols and on the player-selected wager level.

9. The method of claim 7, further comprising, receiving data representing a payment for the virtual lottery ticket from the player based on a quantity of the player-selected symbols, on the player-selected wager level, and a quantity of draws selected by the player.

10. The method of claim 7, wherein receiving data representing the player selection of one or more of a plurality of different symbols for the virtual lottery ticket and receiving data representing for each player-selected symbol for the virtual lottery ticket, the player selection of one of the plurality of different wager levels comprises receiving data based on a virtual playslip from the player.

11. The method of claim 7, which comprises receiving, via a mobile device, the data representing the player selection of one or more of a plurality of different symbols for the virtual lottery ticket and the data representing player selection of one of the plurality of different wager levels.

12. The method of claim 7, which comprises receiving, via a mobile device, a payment for the virtual lottery ticket.

13. The method of claim 7, wherein the symbols comprise a plurality of numbers, and wherein the plurality of different wager levels comprises four different wager levels.

14. A gaming system comprising:

a processor; and a memory device which stores a plurality of instructions, which when executed by the processor, cause the processor to:

for a play of a lottery game, generate a first virtual lottery ticket based on:

received data representing a first player selection of a first symbol from a plurality of different symbols for the first virtal lottery ticket, received data representing a first player selection of a first wager level from a plurality of different wager levels for the first symbol for the first virtual lottery ticket, and a first random selection of a first award from a plurality of different awards for association with the first symbol for the first virtual lottery ticket, wherein the first random selection is in accordance with predetermined odds of randomly selecting each of the plurality of different awards associated with the first wager level, wherein the plurality of different wager levels have different predetermined odds; and for the play of the lottery game, generate a second virtual lottery ticket based on:

received data representing a second player selection of the same first symbol from the plurality of different symbols for the second virtual lottery ticket, received data representing a second player selection of the same first wager level from the plurality of different wager levels for the first symbol for the second virtual lottery ticket, and a second random selection of a second award from the plurality of different awards for association with the first symbol for the second virtual lottery ticket, said second random selection being in accordance with the predetermined odds of randomly selecting each of the plurality of different awards associated with the same first wager level, wherein the first randomly selected award is different than the second randomly selected award; and for the play of the virtual lottery game, after the generation of the first virtual lottery ticket and the second virtual lottery ticket, randomly select one of the plurality of different symbols as the drawn symbol for the play of the lottery game.

15. The gaming system of claim 14, wherein the first virtual lottery ticket and the second virtual lottery ticket are wagerable on by a same player.

16. The gaming system of claim 14, wherein the first virtual lottery ticket and the second virtual lottery ticket are wagerable on by different players.

17. A gaming system comprising:

a processor; and a memory device which stores a plurality of instructions, which when executed by the processor, cause the processor to:

for a play of a lottery game, generate a first virtual lottery ticket based on:

received data representing a first player selection of a first symbol from a plurality of different symbols for the first virtual lottery ticket, received data representing a first player selection of a first wager level from a plurality of different wager levels for the first symbol for the first virtual lottery ticket, and a first random selection of a first award from a plurality of different awards for association with the first symbol for the first virtual lottery ticket, wherein the first random selection is in accordance with predetermined odds of randomly selecting each of the plurality of different awards associated with the first wager level, wherein the plurality of different wager levels have different predetermined odds; and for the play of the lottery game, generate a second virtual lottery ticket based on:

received data representing a second player selection of a second symbol from the plurality of different symbols for the second virtual lottery ticket, the second symbol being different from the first symbol, received data representing a second player selection of the same first wager level from the plurality of different wager levels for the second symbol for the second virtual lottery ticket, and a second random selection of a second award from the plurality of different awards for association with the second symbol for the second virtual lottery ticket, the second random selection being in accordance with the predetermined odds of randomly selecting each of the plurality of different awards associated with the same first wager level, wherein the first randomly selected award is the same as the second randomly selected award; and for the play of the lottery game, after the generation of the first virtual lottery ticket and the second virtual lottery ticket, randomly select one of the plurality of different symbols as the drawn symbol for the play of the lottery game.

18. The gaming system of claim 17, wherein the first virtual lottery ticket and the second virtual lottery ticket are wagerable on by a same player.

19. The gaming system of claim 17, wherein the first virtual lottery ticket and the second virtual lottery ticket are wagerable on by different players.

* * * * *